US006435146B1

(12) United States Patent
Kantola et al.

(10) Patent No.: US 6,435,146 B1
(45) Date of Patent: Aug. 20, 2002

(54) ENGINE OILING DISTRIBUTION SYSTEM FOR PURGING AIR AND METHOD OF USE

(75) Inventors: James C. Kantola, Waukegan; Richard P. Kolb, Prairieview; David J. Hartke, Gurnee, all of IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/694,186

(22) Filed: Oct. 23, 2000

(51) Int. Cl.[7] ..... F02B 33/04

(52) U.S. Cl. ..... 123/73 AD; 123/196 R; 184/6.8

(58) Field of Search ..... 123/73 AD, 196 M, 123/196 R; 184/6.8

(56) References Cited

U.S. PATENT DOCUMENTS 5,145,328 A * 9/1992 Harwath ..... 417/299
5,297,511 A * 3/1994 Suzuki ..... 123/196 R
5,941,745 A * 8/1999 Kanno ..... 123/34 AD

* cited by examiner

*Primary Examiner*—Noah P. Kamen
(74) *Attorney, Agent, or Firm*—Timothy J. Ziolkowski

(57) ABSTRACT

The present invention includes an oiling distribution system having an oil distribution manifold for evenly distributing engine oil to the cylinders of an internal combustion engine and an adapter base for coupling to the oil distribution manifold having therein an air purging passage for purging any air accompanying the oil exiting an oil pumping system. The air purging passage discharges air to the oil distribution manifold wherein the air is transported to the fuel system of an internal combustion engine through a fuel system oiling outlet. The air purging passage has an air inlet and air outlet that are sufficient size to allow the transport of air but minimize the flow of oil through the air purging passage. The present invention also provides a method for purging air from an oiling system.

34 Claims, 5 Drawing Sheets

ENGINE OILING DISTRIBUTION SYSTEM FOR PURGING AIR AND METHOD OF USE

BACKGROUND OF THE INVENTION

The present invention relates generally to oiling systems for internal combustion engines, and more specifically, to an air purging system for use with a two-stroke internal combustion engine.

Typically, two-stroke outboard marine engines did not have a separate oiling system. That is, these prior art engines required pre-mixing lubricant and fuel so that the lubricant dissolves in the fuel to lubricate the engine. This required consistent, accurate measuring and agitation of the mixture. There are many disadvantages to the prior art system of pre-mixing lubricant and fuel. For example, since various two-stroke engines require different mix concentrations, many outboard marine engine owners who also own other two-stroke engine equipment, such as various lawn and garden equipment and ATV's, may store several different concentrations of oil/fuel mixture. This is not only an aggravation to the owner, but is also problematic if the containers become mixed up and the owner uses the wrong concentration for a particular two-stroke engine. While this is not catastrophic, if run over time with the wrong concentration, a two-stroke engine wears excessively.

The present invention is for use in a unique lubrication system for two-stroke engines. Such a lubrication system must not only provide lubrication to each cylinder of the engine, it must also provide lubrication to the fuel system to properly lubricate the fuel metering and injection system. As is well known, air entrained in the oil, can hinder a properly operating lubrication system. It is therefore desirable to remove any air from the oil, while preventing any such air in the oil system from being fed to the cylinders of the engine. As is known, air in such a system can prevent oil flow, especially where check valves are used, resulting in a phenomena known as "air lock." If an oil passage becomes air locked, the operator would have no way of knowing that the affected cylinder is not receiving sufficient oil, and continued operation of the engine will result in severe damage to that particular cylinder.

It would therefore be desirable to have an air purging system that can purge air from the oil system while providing oil to the fuel system components.

SUMMARY OF THE INVENTION

The present invention provides an oiling distribution system for an oil pumping system of an internal combustion engine. The system includes an oil distribution manifold for distributing engine oil to each cylinder of an internal combustion engine. The oil distribution manifold further includes a fuel system outlet that purges air from the oil distribution manifold along with oil to the fuel system of the internal combustion engine. The system also includes an adapter having therein an air purging passage in an internal chamber. The air purging passage allows air entrained in the oil entering the internal chamber to be transported to the oil distribution manifold. All of which overcome the aforementioned drawbacks.

In accordance with one aspect of the invention, a base to adapt an oil distribution system to an oil pumping system of an internal combustion engine is provided. The base includes an oil outlet end in fluid communication with the oil distribution system. The base also includes a check valve located between the oil inlet end and the oil outlet end to regulate the flow of pressurized oil to the oil outlet end and an air purging passage that allows air entrained in the pressurized oil to escape to the oil distribution manifold through an air outlet. The air purging passage includes the air outlet in the oil outlet end and an air inlet in the oil inlet end. The oil inlet end is in fluid communication with the oil pumping system.

In accordance with another aspect of the invention, an oil distribution manifold and an oiling system adapter base coupled thereto are provided. The oil distribution manifold and the oiling system adapter base form an oiling distribution system for use with a two-stroke internal combustion engine. The oil distribution manifold includes a plurality of cylinder oiling outlets to supply oil to each cylinder of an engine and a fuel system oiling outlet to supply oil and any air in the oil system to a fuel system of the internal combustion engine. The oiling system adapter base which is coupled to the oil distribution manifold includes a cylindrical chamber and a bleed slot to purge air from the cylindrical chamber to the fuel system oiling outlet.

The invention also includes a method for purging air to a fuel system of an internal combustion engine. The method includes supplying oil to an internal passage having a check valve therein and periodically allowing oil to open the check valve and pass through the internal chamber. As air may accumulate when the check valve is closed, the method further includes bleeding air through a bleed slot and routing the air through the bleed slot to a fuel system of an internal combustion engine.

Another aspect of the present invention is to provide a method for bleeding air from the oil system of an internal combustion engine wherein a distribution manifold includes a centrally located dome having a plurality of cylinder outlet outlets and a fuel system outlet is coupled to an adapter having a cylinder chamber and a bleed slot. The method further includes the step of providing an air outlet port in communication with a fuel system outlet port. Oil from an oil pumping system is injected into a frusto-conical oil inlet port of the adapter. A check valve housed within a cylindrical chamber of the adapter regulates the flow of oil to the distribution manifold. The method then bleeds air entrained in the oil through the bleed slot between the check valve and the oil inlet port to the oil distribution manifold.

Various other features, objects and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

The operating environment of the present invention herein is described with respect to two-cycle outboard marine engines. However, it will be appreciated by those of ordinary skill in the art that the present invention is equally applicable for use with other types of internal combustion engines, such as diesel engines, using a distribution manifold for distributing engine oil to a plurality of cylinders and a fuel system.

Figure 1:
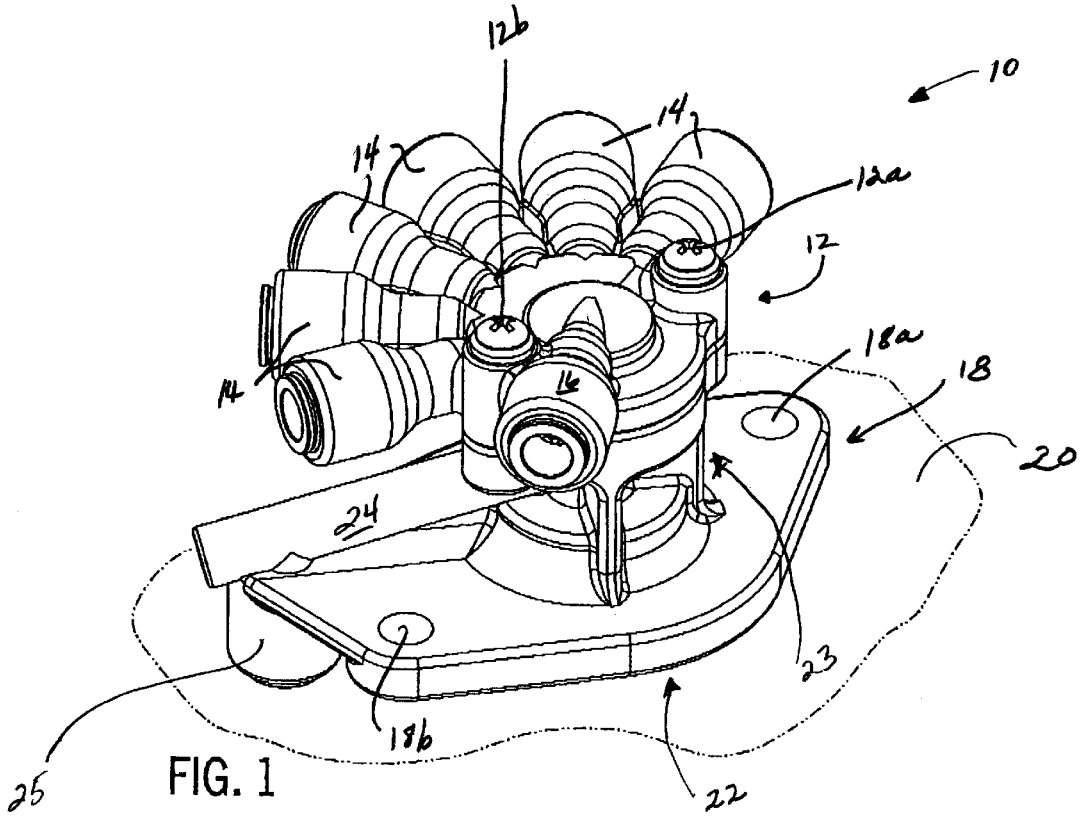
FIG. 1 is a perspective view of an oiling distribution system as assembled for use with a two-stroke outboard marine engine.

Referring to FIG. 1, an oiling distribution system 10 includes a distribution manifold 12 having a plurality of cylinder outlet housings 14 for each cylinder of a two-stroke internal combustion engine, such as those used for outboard marine engines. In this embodiment, distribution manifold 12 has six outlets 14, one for each cylinder of a six cylinder engine and a fuel system oiling outlet housing 16. The manifold 12 is mounted to an oil system adapter 18 shown coupled to the manifold 12 18 with mounting bolts 12*a,* 12*b.* The oil system adapter 18 is mounted to the engine 20 through mounting bores 18*a,* 18*b.* Oil is introduced into the oil system adapter 18 in oil inlet 22 from an oil pumping system (not shown). The adapter 18 includes a cylindrical chamber 23. A vacuous tube 24 extends from the cylindrical chamber 23 downwardly to the base of the adapter 18. An oil pressure switch can be inserted in a pressure switch port 25 that is on the underside of the adapter 18. The vacuous tube 24 allows air in the pressure switch port 25 to be transported to the cylindrical chamber 23.

Figure 2:
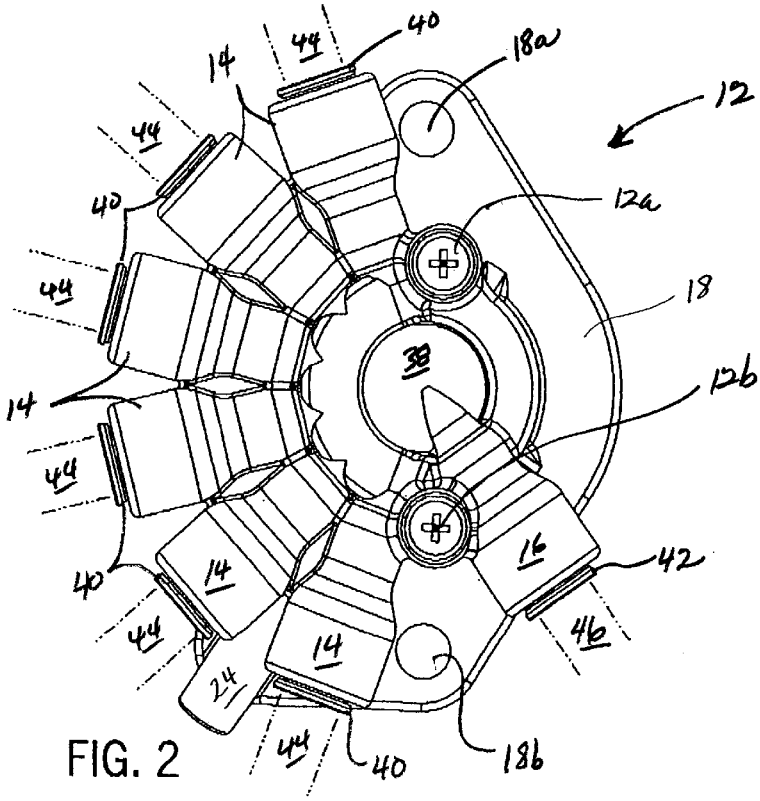
FIG. 2 is a top view of a distribution manifold used in the oiling distribution system of FIG. 1.

FIG. 2 shows a top view of the distribution manifold 12 for use with a two-stroke internal combustion engine. The cylinder outlet housings 14 are angled equidistantly about a centrally-located dome 38, preferably, at an angle of incidence of 28 degrees. The cylinder outlet housings 14, as well as the fuel system oiling outlet housing 16, each contain a push-to-connect fitting 40, 42. The push-to-connect fittings 40 for the cylinder outlet housings 14 retain a hose 44 in fluid communication with each cylinder of the internal combustion engine. The push-to-connect fitting 42 for the fuel system oiling outlet housing 16 also retains a hose 46 in fluid communication with a fuel separator (not shown) of the fuel system. The push-to-connect fittings 40, 42 are designed to prevent leakage, allow easy coupling of the hoses 44, 46, lock the hoses 44, 46 to the manifold outlets 15, 16, and allow easy decoupling of the hoses 44, 46 when needed.

Figure 3:
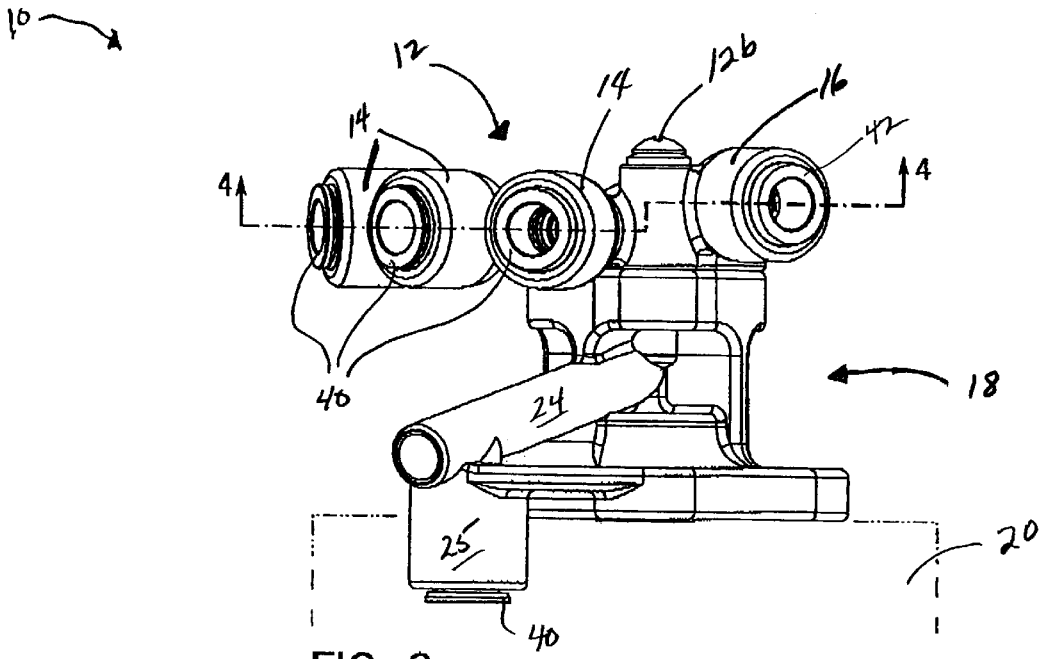
FIG. 3 is a front elevational view of the oiling distribution system shown in FIG. 1.

Referring now to FIG. 3, the fuel system outlet housing 16 is shown preferably positioned at a higher elevation than the cylinder outlet housings 14 to purge air from the distribution manifold 12 and the oiling system 10. The positioning of the fuel system oiling outlet housing 16 above the cylinder outlet housings 14 allows air that accumulates in dome 38 to purge through the fuel system oiling outlet housing 16 to the fuel separator where it is vented to the atmosphere. As shown, the cylinder outlet housings 14 share a plane that is significantly below the plane of the fuel system oiling outlet housing 16. The adapter 18 is shown coupled to the manifold 12 using mounting bolts 12*a* and 12*b*. The adapter 18 is then bolted to an oil source housing, such as an engine 20. As further shown the pressure switch port 25 includes a push-to-connect fitting 40 to retain a pressure switch and/or plug (not shown) therein.

Figure 4:
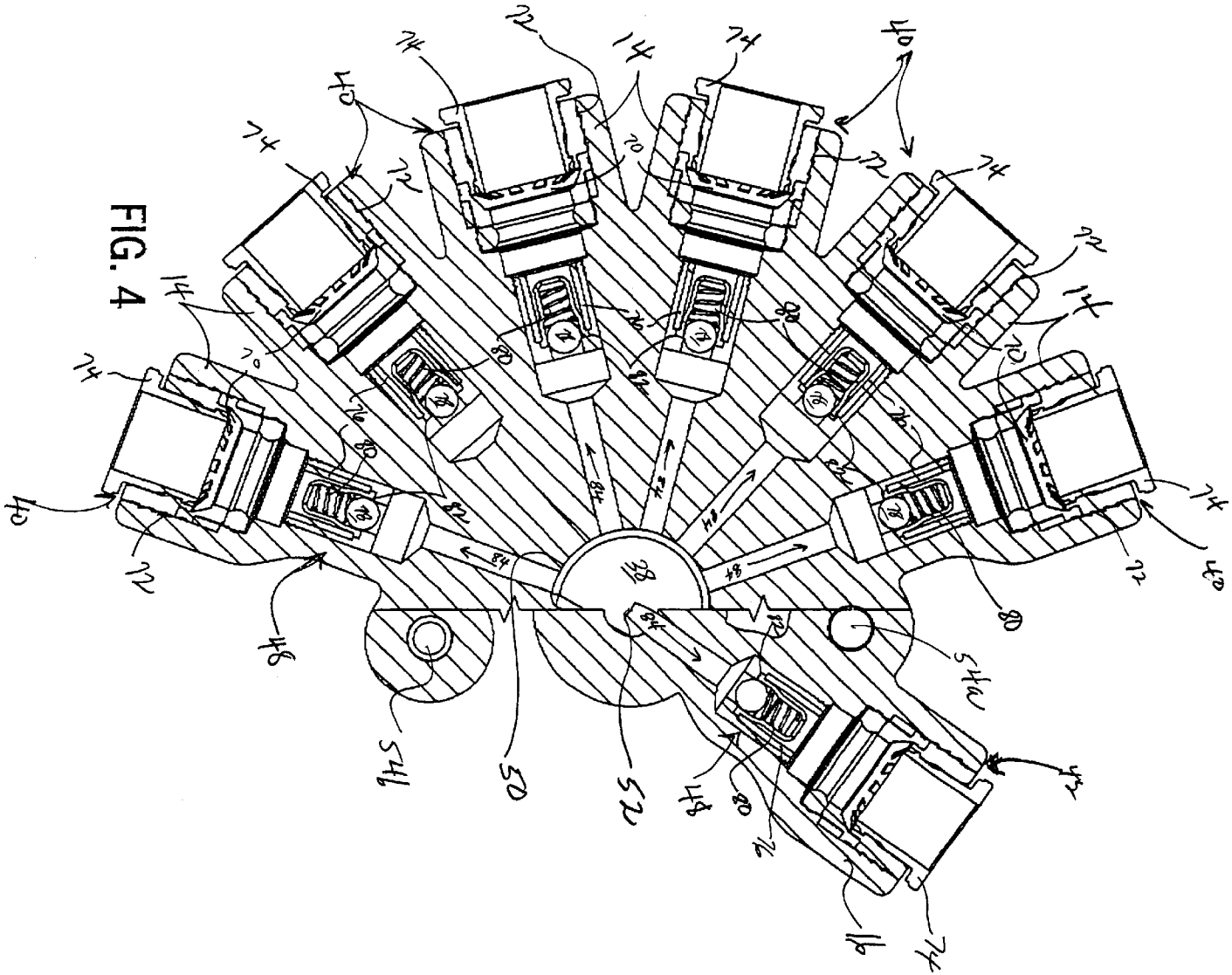
FIG. 4 is a cross-section top view of the distribution manifold of FIG. 3 taken along line 4—4 of FIG. 3.

FIG. 4 illustrates an enlarged, cross-sectional view of the distribution manifold 12 of the oiling system 10. The cylinder outlet housings 14 and the fuel system oiling outlet housing 16 each include an oiling check valve 48 that regulates the flow of oil from the centrally-located dome 38 to the cylinders and fuel system of the internal combustion engine, respectively. The cylinder outlet housings 14 extend from a side edge 50 of the centrally-located dome 38 whereas the fuel system oiling outlet housing 16 extends from an apex 52 of the centrally-located dome 38. Two mounting bores 54*a,* 54*b* are provided in manifold 12 to receive mounting bolts 12*a,* 12*b,* FIG. 1, to secure the distribution manifold 12 to the oil system adapter 18.

The push-to-connect fittings 40, 42 include a seal 66 that prevents leakage between the housing 16 and the push-to-connect fittings 40, 42. A ring sleeve 68 supports an internal gripping ring 70. The gripping ring 70 positively clamps a hose in position in the housings 14, 16. The push-to-connect fittings 40, 42 also include a barbed retaining sleeve 72 to hold the push-to-connect fittings 40, 42 securely within the housings 14, 16. The push-to-connect fittings 40, 42 further include a release mechanism 74, that when depressed, releases the gripping ring 70 to allow the hose to be removed. The release mechanism 74 of the push-to-connect fittings 40, 42 thus allows for a quick disconnection of the hose, which is otherwise firmly-secured by the gripping ring 70. A preferred fitting is a ¼" nickel-plated Legris Carstick® fitting made by Legris, Inc.

The oiling check valves 48 each contain a locking ring 76 to lock the oiling valve within the housings 14, 16. The oiling check valves 48 include a check ball 78 and a spring 80 to bias the check ball 78 against a check valve seat 82. Pressure from the oil against the check ball 78 accumulates until it exceeds an opposing bias force from the spring 80, at which point the spring 80 compresses and unseats the check ball 78 to permit oil to flow around the check ball 78 in a first direction 84 through the oiling check valves 48 and through the outlet housings 14, 16. The oiling check valves 48 prevent oil flow backward, or around the check ball 78 in a direction opposite to the flow path 84. In this manner, fuel from the fuel system is prevented from entering the oil distribution system 10. Upon biasing the check ball 78 of the oiling check valve 48 within the fuel system oiling outlet housing 16, the oil and air are free to flow to the fuel system separator.

Figure 5:
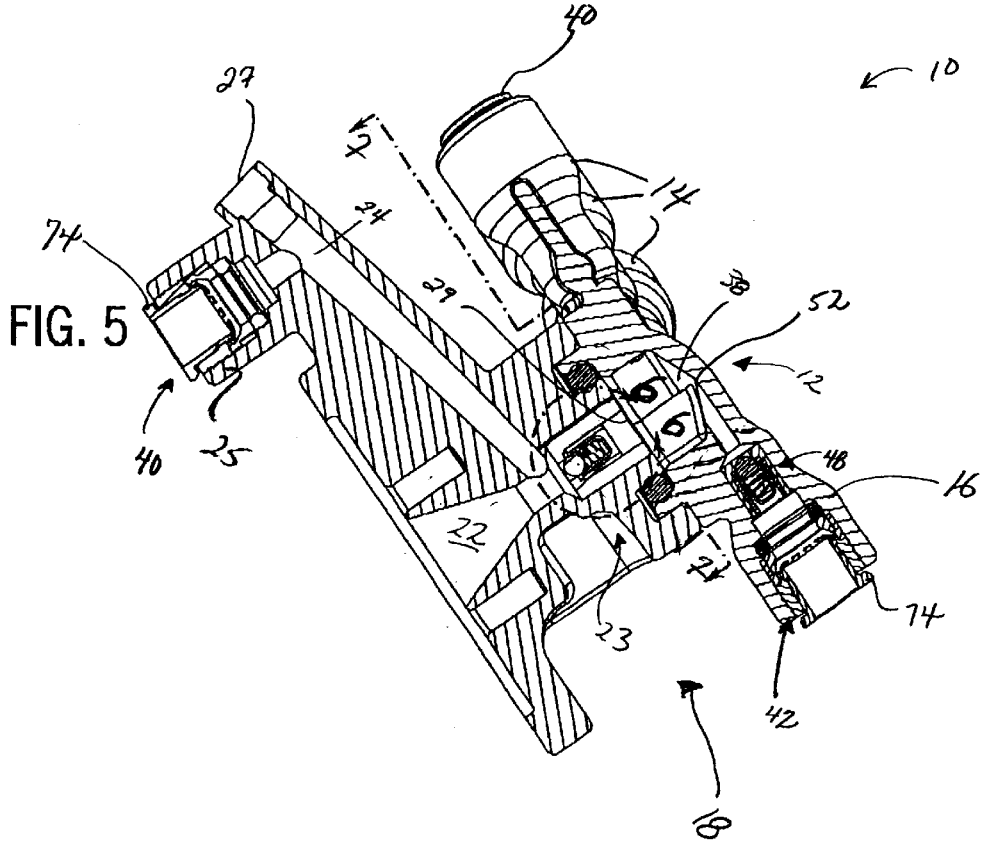
FIG. 5 is a cross-sectional side view of the oiling distribution system of FIG. 3.

FIG. 5 is a cross-sectional side view of the oiling distribution system 10 shown with the oil distribution manifold 12 coupled to the oil system adapter 18. As shown, the oil inlet 22 has a frusto-conical shape. By utilizing a frusto-conical oil inlet 22, the flow of oil from the oil pumping system is regulated. Moreover, the frusto-conical shape allows the oil inlet 22 to force any air entrained in the oil upstream toward the cylindrical chamber 23. Further, using an oil inlet 22 having a frusto-conical shape eliminates pockets for potential accumulation of air entrained in the oil.

Still referring to FIG. 5, the oil pressure switch port 25 further includes a push-to-connect fitting 40 similar to the other push-to-connect fittings that are inserted into each of the plurality of cylinder oiling outlets 14 and the fuel system outlet 16. As shown, the vacuous chamber 24 intersects the cylindrical chamber 23 and extends downwardly towards the oil pressure switch port 25. One of ordinary skill in the art will appreciate that use of the vacuous chamber 24 and the pressure switch port 25 are not a pre-requisite for full implementation of the present invention. As such, the vacuous chamber 24 could be plugged at an inlet end 27. Further, the push-to-connect fitting 40 could be removed from the pressure switch port 25 and the port closed off during the molding process of oil system adapter 18 or, a plug can be installed into the push-to-connect fitting 40 to close off the pressure switch port 25.

Figure 6:
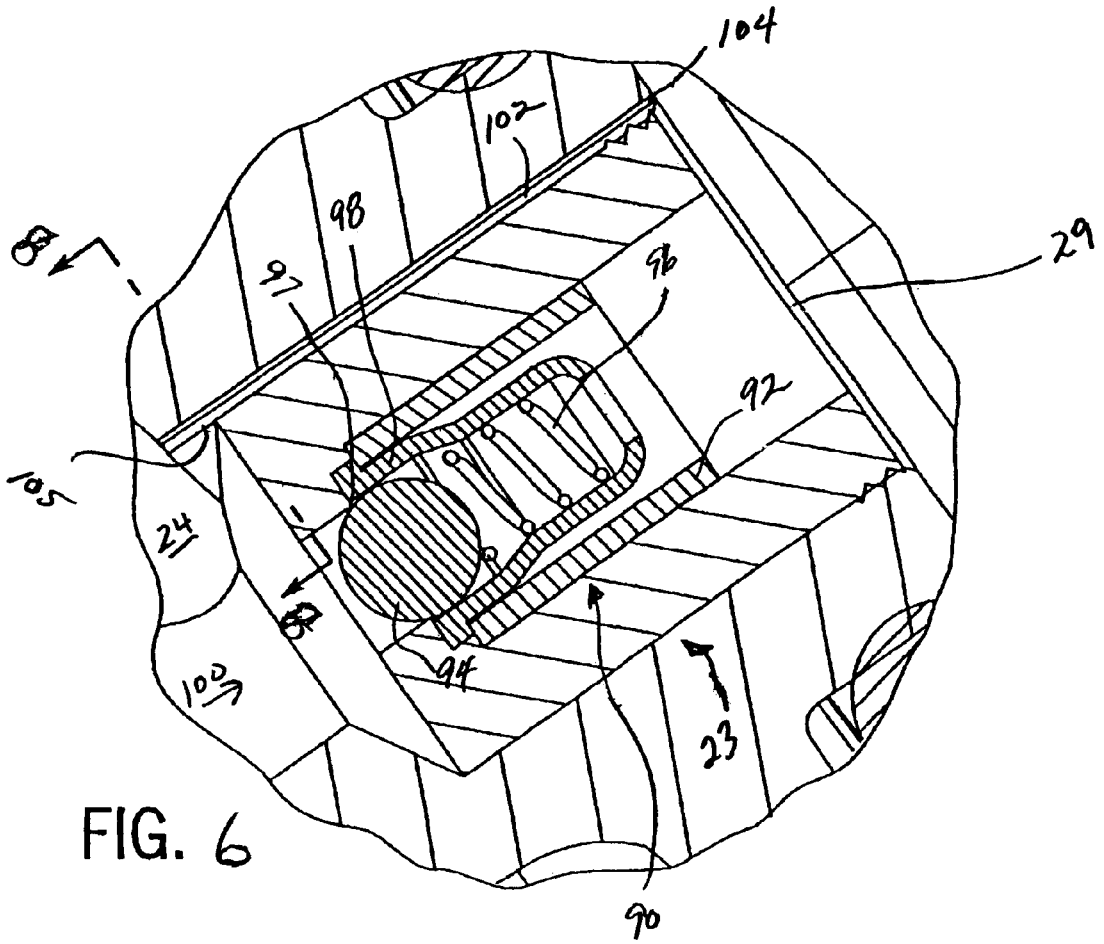
FIG. 6 is a cross-sectional view of a portion of the oiling distribution system taken along line 6—6 of FIG. 5.

FIG. 6 is an enlarged view of the cylindrical chamber 23 taken along lines 6—6 of FIG. 5. The cylindrical chamber 23 includes a check valve 90 that regulates the flow of oil from the oil inlet 22 toward the oil distribution manifold 12. The cylindrical chamber check valve 90 contains a locking ring to lock the cylindrical chamber check valve within the cylindrical chamber 23. The cylindrical chamber check valve 90 includes a check ball 94 and a spring 96 to bias the check ball 94 against a check valve seat 97. Pressure from the oil against the check ball 90 accumulates until it exceeds an opposing bias force from the spring 96, at which point the spring 96 compresses and unseats the check ball 94 to permit oil to flow around the check ball 94 in a first direction 100 through the cylindrical chamber check valve 90 toward the oil distribution manifold 12. The cylindrical chamber check valve 90 prevents oil flow backwards, or around the check ball 94 in a direction opposite to the flow path 100. In this manner, oil in the oil distribution manifold 12 is prevented from flowing back to the oil pumping system.

Extending parallel to the cylindrical chamber check valve 90 is an air purging passage 102 having an air outlet 104. An air inlet 105 receives air entrained in the pressurized oil that is then allowed to escape through the air purging passage 102 and discharged to the oil distribution manifold 12 through the air outlet 104. The air purging passage 102 is sized to allow air passage, yet restrict oil flow therethrough.

Figure 7:
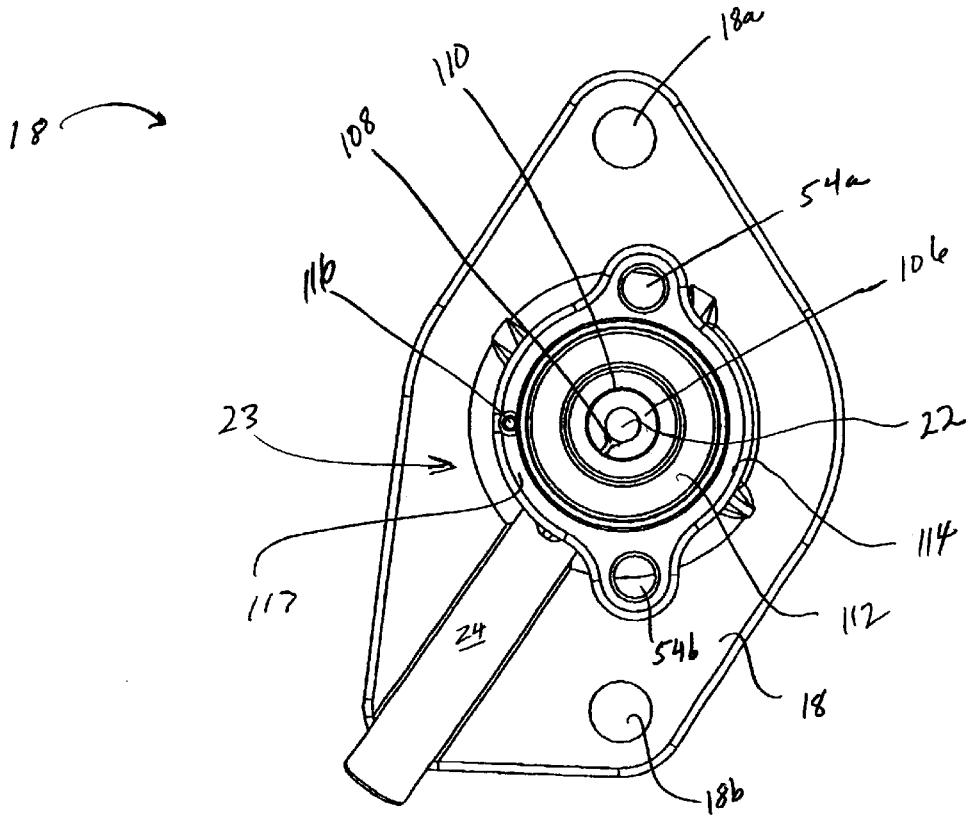
FIG. 7 is a cross-sectional top view of a portion of the oiling distribution system taken along line 7—7 of FIG. 5.

Now referring to FIG. 7, which is taken along lines 7—7 of FIG. 5, the oil system adapter 18 is shown without the check valve 48 in the cylindrical chamber 23. The oil inlet 22 extends upwardly to the cylindrical chamber 23 so as to form a cylindrical chamber check valve stop 106. Extending along the surface of the stop 106 is the air inlet 108 that intersects the air purging passage 102 which runs parallel along the inner wall 110 of the cylindrical chamber 23. The inner cylindrical wall 110 extends upwardly so as to form a recessed circular section 112 between the inner cylindrical wall 110 and an outer cylindrical wall 114. An O-ring (not shown) is then placed in the recessed section 112 to create a seal when coupling the adapter 18 to the oil distribution manifold 12. To ensure proper alignment of the oil distribution manifold 12 when coupling to the oil system adapter 18, a notch 116 is provided in an upper surface 117 of the adapter 18. The notch 116 extends upwardly from the upper surface 117 and is received into an opening (not shown) on the oil distribution manifold 12.

Figure 8:
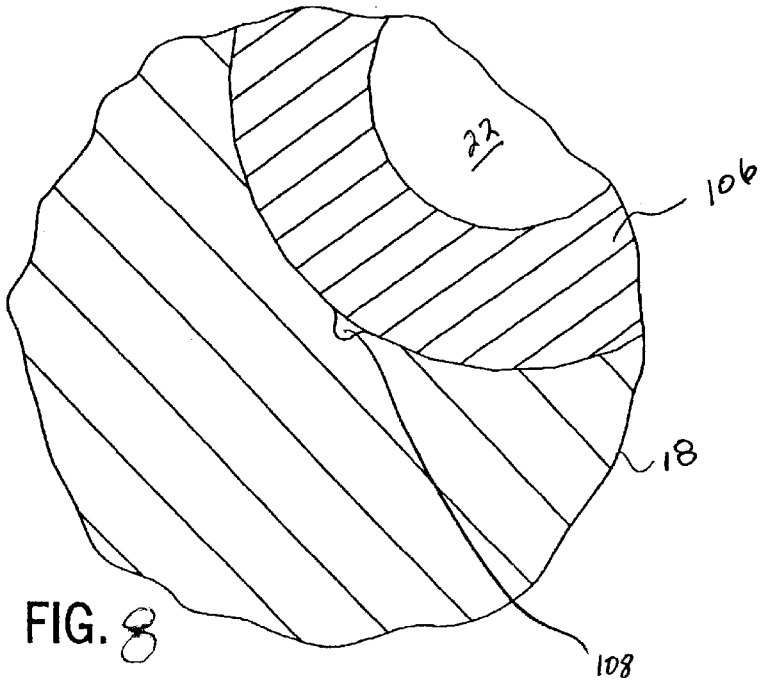
FIG. 8 is a cross-sectional view of a portion of the oiling distribution system taken along line 8—8 of FIG. 6.

The relative position of the check valve stop 106 and the air purging passage 102 in the adapter 18 is further shown in FIG. 8. Taken along line 8—8 of FIG. 6, FIG. 8 shows the air purging passage 102 positioned along the surface of the check valve stop 106 and extending up the side of the adapter 18. The air inlet passage 102 is teardrop shaped which, together with its size, minimizes oil passage, yet allows air to escape therethrough.

The present invention discloses an oiling distribution system 10 for use with a two-stroke internal combustion engine. The system 10 includes an oil distribution manifold 12 having a plurality of cylinder oiling outlets 14 to supply oil to each cylinder of the internal combustion engine as well as a fuel system oiling outlet 16 to supply oil to the fuel system of the internal combustion engine. The system further includes an oiling system adapter base 18 that when coupled to the oil distribution manifold 12 allows air entrained in the oil exiting an oil pumping system of an internal combustion engine to be discharged in the oil distribution manifold 12 and expunged to the fuel system separator through the fuel system oiling outlet 16. The oiling system adapter base 18 includes a cylindrical chamber 23 housing a check valve 90 to regulate the flow of oil to the oil distribution manifold 12 as well as an air urging passage 102 having an air inlet 108 and an air outlet 104 for discharging air entrained in the oil to the oil distribution manifold 12.

Accordingly, a method for purging air entrained in oil entering an oil distribution manifold 12 is provided. Oil is supplied to an internal chamber 23 having a check valve therein 90 that is periodically allowed to open when a check ball 94 is biased against a valve seat 92 by a spring 96 when oil pressure is at a predetermined value. Opening of the check valve 90 allows oil exiting the oil pumping system to pass through to an oil distribution manifold 12. To avoid air entrained in the pressurized oil from accumulating against the check ball 94 of the check valve 90, it is necessary to then purge or bleed the air through the air purging passage 102 which has an air outlet 104 in the oil distribution manifold 12. The method then discharges the air deposited in the oil distribution manifold 12 through the fuel system of the internal combustion engine through the fuel system oiling outlet 16.

The present invention has been described in terms of the preferred embodiment, and it is recognized that equivalents, alternatives, and modifications, aside from those expressly stated, are possible and within the scope of the appending claims.

What is claimed is:

1. A base to adapt an oil distribution system to an oil pumping system of an internal combustion engine comprising:

an oil inlet end in fluid communication with an oil system;

an oil outlet end in fluid communication with an oil distribution system;

a check valve located between the oil inlet end and the oil outlet end to regulate the flow of pressurized oil to the oil outlet end;

an air purging passage having an air outlet in the oil outlet end and an air inlet in the oil inlet end, wherein air entrained in the pressurized oil is allowed to escape through the air purging passage; and an oil inlet having a frusto-conical configuration to receive pressurized oil and air and to regulate the flow of oil and air from the oil pumping system to the check valve.

2. The base of claim 1 wherein the oil distribution system includes an oil distribution manifold and the air purging passage is arranged parallel to the check valve and allows air to escape from the oil inlet end to the oil distribution manifold.

3. The base of claim 2 wherein the check valve comprises a valve seat and a spring to bias a check ball against the valve seat at a predetermined pressure.

4. The base of claim 2 wherein the oil distribution manifold further comprises:

a number of cylinder oiling outlets, the number of which corresponds to a number of cylinders in the internal combustion engine, and a fuel system oiling outlet.

5. The base of claim 4 wherein the number of cylinder oiling outlets are in fluid communication with a centrally located dome.

6. The base of claim 5 wherein the fuel system oiling outlet is positioned at a height axially above the number of cylinder oiling outlets.

7. The base of claim 4 wherein each of the number of cylinder oiling outlets are equidistant from one another.

8. An oiling distribution system for use with a two-stroke internal combustion engine comprising:

an oil distribution manifold having a plurality of cylinder oiling outlets to supply oil to each cylinder of an engine and a fuel system oiling outlet to supply oil to a fuel system of the engine; and an oiling system adaptor base having a cylindrical chamber coupled to the oil distribution manifold and a bleed slot to purge air from the cylindrical chamber to the fuel system oiling outlet.

9. The oiling distribution system of claim 8 wherein the bleed slot is configured parallel to the cylindrical chamber and is sized large enough to allow air passage and small enough to minimize oil passage.

10. The oiling distribution system of claim 9 wherein the check valve comprises a valve seat and a spring to bias a check ball against the valve seat at a predetermined pressure and the bleed slot has an opening in an internal wall of the oiling system adapter base and runs parallel with the check valve.

11. The oiling distribution system of claim 9 wherein the oil outlet is in fluid communication with the oil distribution manifold and the oil inlet is in fluid communication with an oil pumping system.

12. The oiling distribution system of claim 8 wherein the cylindrical chamber further comprises an oil transport chamber formed by an oil outlet in an oil outlet end and an oil inlet in an oil inlet end, wherein the oil transport chamber includes a check valve between the oil inlet and the oil outlet, and the bleed slot is an air by-pass to the check valve.

13. The oiling distribution system of claim 8 wherein the bleed slot further comprises an air outlet end having an air outlet in communication with the fuel system oiling outlet and an air inlet end having an air inlet in communication with the cylindrical chamber of the oiling system adaptor base.

14. The oiling distribution system of claim 13 wherein the air inlet receives air in the cylindrical chamber and allows the air to escape through the bleed slot to be transported upstream to the air outlet, wherein the air outlet discharges the air to the oil distribution manifold.

15. The oiling distribution system of claim 8 wherein the oil distribution manifold further comprises a centrally located dome having a notch along an upper interior surface therein, wherein the notch is configured to receive air from the bleed slot.

16. The oiling distribution system of claim 15 wherein the notch is further configured to be in communication with the fuel system oiling outlet.

17. The oiling distribution system of claim 16 wherein the fuel system oiling outlet is positioned at a height axially above the plurality of cylinder oiling outlets.

18. The oiling distribution system of claim 8 wherein the oiling system adaptor base further comprises a pressure sensing switch and a vacuous chamber communicating with the cylindrical chamber to allow passage of any air from the pressure sensing switch to the cylindrical chamber.

19. A method for purging air to a fuel system of an internal combustion engine, comprising the steps of:

supplying oil to an internal chamber having a check valve therein; periodically allowing oil to open the check valve and pass through the internal chamber;

bleeding air that may accumulate in the internal chamber when the check valve is closed through a bleed slot;

routing the air through the bleed slot and to a fuel system of an internal combustion engine; and configuring the bleed slot to bypass around thc internal chamber.

20. The method of claim 19 wherein the step of periodically allowing oil to open the check valve further includes the step of biasing a check ball with a spring against a valve seat.

21. The method of claim 19 further comprising the step of releasing air from the internal chamber to a manifold.

22. The method of claim 19 further comprising the step of providing a frusto-conical oil inlet to regulate the flow of oil to the internal chamber, wherein the oil inlet is in fluid communication with an oil pumping system of the internal combustion engine.

23. A method for bleeding air from an oil system of an internal combustion engine comprising the steps of:

configuring a distribution manifold comprising a centrally located dome having a plurality of cylinder outlet ports and a fuel system outlet port;

providing an air outlet port in communication with the fuel system outlet port;

coupling to the distribution manifold an adaptor having a cylindrical chamber including a check valve, and a frusto-conical oil inlet port, and a bleed slot, wherein the bleed slot communicates with the air outlet port; and connecting the adaptor to an oil pumping system.

24. The method of claim 23 further comprising the step of purging air entrained between the check valve and the oil inlet port, wherein the step of purging further includes the step of directing air to an air inlet of the bleed slot.

25. The method of claim 23 further comprising the step of transporting air in the bleed slot to bypass the check valve and the step of discharging the air through the air outlet port to the fuel system outlet port.

26. The method of claim 23 wherein the steps of configuring an adaptor further includes the steps of providing a pressure activation switch and a vacuous chamber to transport any air from the pressure activation switch to the cylindrical chamber.

27. A base to adapt an oil distribution system to an oil pumping system of an internal combustion engine comprising:

an oil inlet end in fluid communication with an oil system; an oil outlet end in fluid communication with an oil distribution system;

a check valve located between the oil inlet end and the oil outlet end to regulate the flow of pressurized oil to the oil outlet end;

an air purging passage having an air outlet in the oil outlet end and an air inlet in the oil inlet end, wherein air entrained in the pressurized oil is allowed to escape through the air purging passage; and wherein the oil distribution system includes an oil distribution manifold and wherein the air purging passage allows air to escape from the oil inlet end to the oil distribution manifold.

28. The base of claim 27 wherein the air purging passage is arranged parallel to the check valve.

29. The base of claim 27 wherein the check valve comprises a valve seat and a spring to bias a check ball against the valve seat at a predetermined pressure.

30. The base of claim 27 wherein the oil distribution manifold further comprises:

a number of cylinder oiling outlets, the number of which corresponds to a number of cylinders in the internal combustion engine, and a fuel system oiling outlet.

31. The base of claim 30 wherein the number of cylinder oiling outlets are in fluid communication with a centrally located dome.

32. The base of claim 30 wherein the fuel system oiling outlet is positioned at a height axially above the number of cylinder oiling outlets.

33. The base of claim 30 wherein each of the number of cylinder oiling outlets are equidistant from one another.

34. The base of claim 27 wherein the oil inlet has a frusto-conical configuration to receive pressurized oil and air and to regulate the flow of oil and air from the oil pumping system to the check valve.

* * * * *